US008548370B2

(12) United States Patent
Choi

(10) Patent No.: US 8,548,370 B2
(45) Date of Patent: Oct. 1, 2013

(54) IMAGE FORMING APPARATUS AND CONTROL METHOD THEREOF

(75) Inventor: Chang Seok Choi, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 351 days.

(21) Appl. No.: 12/652,180

(22) Filed: Jan. 5, 2010

(65) Prior Publication Data

US 2010/0172666 A1 Jul. 8, 2010

(30) Foreign Application Priority Data

Jan. 7, 2009 (KR) ..... 10-2009-0001233

(51) Int. Cl.
*G03G 15/00* (2006.01)

(52) U.S. Cl.
USPC ..... 399/394; 399/388

(58) Field of Classification Search
USPC ..... 399/394
See application file for complete search history.

(56) References Cited

U.S. PATENT DOCUMENTS 4,763,162 A * 8/1988 Yagasaki ..... 399/18
5,112,000 A * 5/1992 Derichs et al. ..... 242/486.4
6,381,441 B1 * 4/2002 Byeon et al. ..... 399/396
6,493,523 B2 * 12/2002 Weaver ..... 399/45
6,496,661 B2 * 12/2002 Ando et al. ..... 399/22
6,704,523 B2 * 3/2004 Takeuchi et al. ..... 399/16
6,766,123 B2 * 7/2004 Ebihara et al. ..... 399/66
7,003,258 B2 * 2/2006 Adachi et al. ..... 399/395
7,693,435 B2 * 4/2010 Moriguchi et al. ..... 399/33
7,881,634 B2 * 2/2011 Zensai ..... 399/121
8,019,246 B2 * 9/2011 Yamada ..... 399/66
8,086,126 B2 * 12/2011 Hotogi et al. ..... 399/61
2006/0045554 A1 * 3/2006 Saeki ..... 399/66
2006/0257156 A1 * 11/2006 Kyung et al. ..... 399/16

FOREIGN PATENT DOCUMENTS

KR 10-659640 12/2006

* cited by examiner

*Primary Examiner* — Anthony Nguyen
(74) *Attorney, Agent, or Firm* — Stanzione & Kim, LLP

(57) ABSTRACT

Disclosed herein is an image forming apparatus and a control method thereof. According to the control method of the image forming apparatus, entry and exit of a recording medium can be sensed without a register sensor by sensing current change of a press roller used to apply a constant pressure to the recording medium and a transfer belt so as to allow the recording medium and transfer belt to come into close contact with each other. In the case of a model provided with a register sensor, the presence of malfunction of the register sensor can be recognized.

7 Claims, 7 Drawing Sheets

IMAGE FORMING APPARATUS AND CONTROL METHOD THEREOF

CROSS-REFERENCE TO RELATED APPLICATIONS

This application claims priority under 35 U.S.C. §119(a) of Korean Patent Application No. 2009-0001233, filed on Jan. 7, 2009 in the Korean Intellectual Property Office, the disclosure of which is incorporated herein by reference.

BACKGROUND

1. Field of the Invention

The present general inventive concept relates to an image forming apparatus and a control method thereof, and, more particularly, to an image forming apparatus capable of sensing entry and exit of paper using a current change value of a press roller and a control method thereof.

2. Description of the Related Art

A paper supply device of an image forming apparatus includes a feed sensor and register rollers. The feed sensor serves to generate signals indicating whether or not paper is picked up and the beginning of image formation. As paper is picked up and moved upward, a tip end of the paper vibrates based on a curling degree thereof. To reduce deviation at the tip end, a register sensor is used to indicate departure of the paper after the paper is aligned with the feed sensor indicating whether or not the paper is picked up. In operation, the feed sensor determines whether or not paper is picked up, enabling recognition of a paper jam, and the register rollers temporarily stop and align the paper if the tip end of the paper reaches between the register rollers. Thereafter, as the paper is moved via a clutch-on operation, the paper strikes the register sensor when passing the register sensor. On a basis of a time when the register sensor is turned on, a controller commands initiation of image formation. Image formation is stopped when the register sensor is turned off.

Conventionally, in the case where recognition of entry and exit of paper depends on the register sensor, paper vibration may cause the image forming apparatus to experience a paper jam, or image omission during printing.

SUMMARY

Therefore, it is an exemplary embodiment of the present general inventive concept to provide an image forming apparatus capable of sensing entry or exit of a recording medium into or from a press roller by sensing a current change of the press roller that is used to make the recording medium come into close contact with a transfer belt, and a control method of the image forming apparatus.

Additional features and utilities will be set forth in part in the description which follows and, in part, will be obvious from the description, or may be learned by practice of the invention.

In accordance with an exemplary embodiment of the present general inventive concept, the above and/or other features and utilities can be achieved by the provision of an image forming apparatus including a press roller to press a recording medium against a transfer belt, a power supply part to apply power to the press roller, a current sensing part to sense a current value of the press roller, and a control part to determine at least one of entry and exit of the recording medium to and from the press roller based on a current value sensed via the current sensing part.

In accordance with another exemplary embodiment of the present general inventive concept, there is provided an image forming apparatus including, a press roller to press a recording medium against a transfer belt, a register sensor provided between the press roller and a register roller and used to sense the recording medium discharged from the register roller, a power supply part to apply power to the press roller, a current sensing part to sense a current value of the press roller, and a control part to determine exit of the recording medium if the current value sensed via the current sensing part is equal to a preset value corresponding to exit of the recording medium when the register sensor senses the recording medium discharged from the register sensor.

In accordance with another exemplary embodiment of the present general inventive concept, there is provided a control method of an image forming apparatus including applying power to a press roller used to press a recording medium against a transfer belt, sensing a current value of the press roller, and determining entry or exit of the recording medium into or from the press roller based on the sensed current value.

Embodiments of the present general inventive concept also provide a printer, comprising a press roller to apply a constant pressure to a recording medium and transfer belt against a driven roller, a power supply part to apply power to the press roller, an electrical resistance sensing part to monitor electrical resistance of the press roller; and a control part to establish whether the recording medium has entered or exited a nip region between the press roller and driven roller based on an electrical resistance value sensed by the electrical resistance sensing part.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
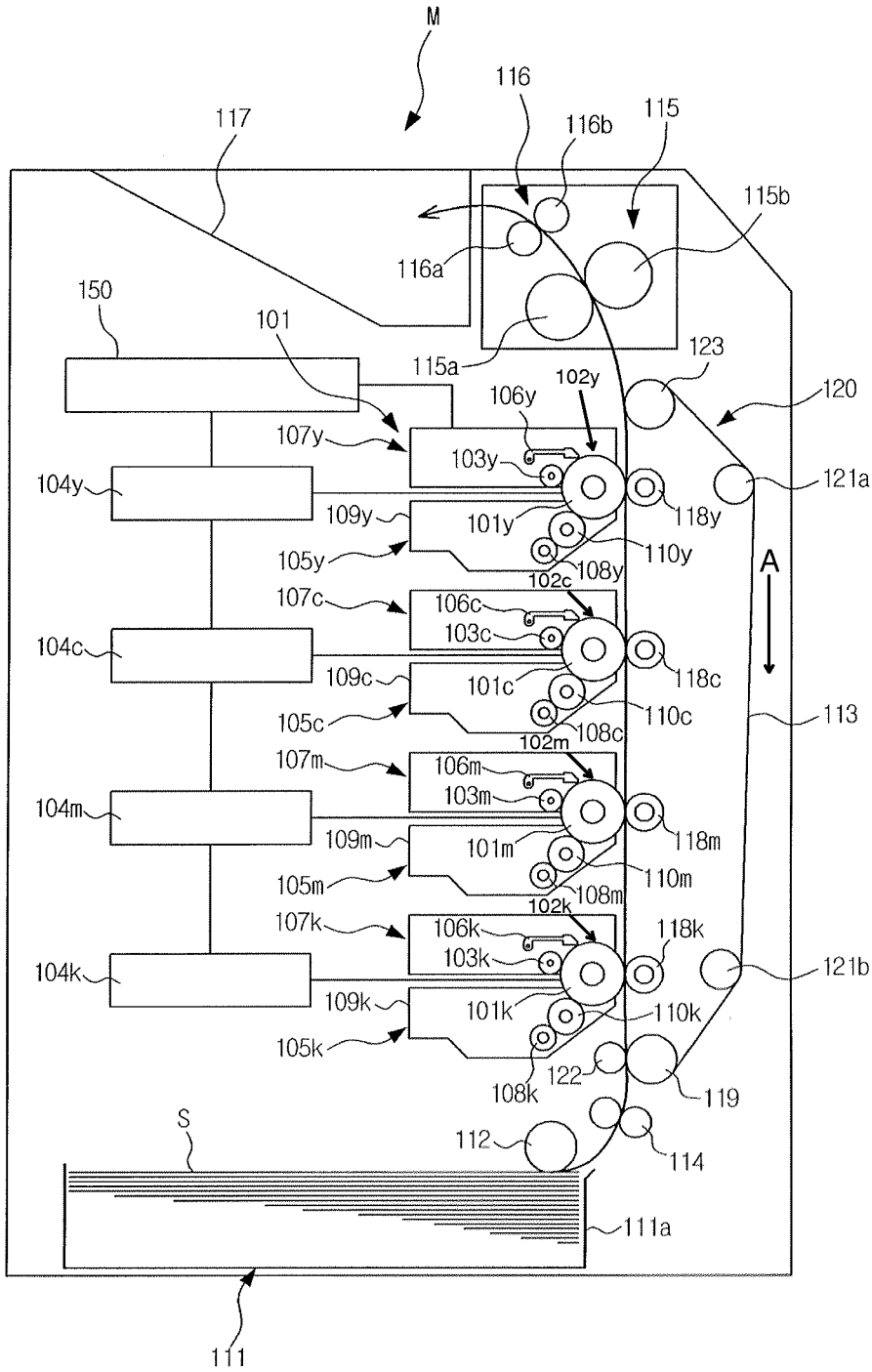
FIG. 1 is a schematic configuration view of an image forming apparatus in accordance with an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments are described below to explain the present general inventive concept by referring to the figures.

FIG. 1 schematically illustrates a configuration of a color image forming apparatus in accordance with an exemplary embodiment of the present general inventive concept. As illustrated in FIG. 1, the color image forming apparatus in accordance with an exemplary embodiment of the present general inventive concept may include a paper supply unit 111, an image forming unit 101, a transfer unit 120, a fixing unit 115, a paper discharge unit 116, and a control part 150.

The paper supply unit 111 may serve to supply recording media S, such as paper. The paper supply unit 111 may include a paper supply cassette 111*a*, a pickup roller 112, and register rollers 114. The paper supply cassette 111*a* may be mounted on the bottom of an apparatus body M. The recording media S, loaded in the paper supply cassette 111*a*, may be picked up by the pickup roller 112 sheet by sheet and delivered to the register rollers 114.

The image forming unit 101 may be arranged above the paper supply unit 111 and may serve to form developer images of desired colors, i.e. black (K), magenta (M), cyan (C), and yellow (Y) developer images on the recording medium S.

The image forming unit 101 may include first, second, third, and fourth photoconductors 101*k*, 101*m*, 101*c*, and 101*y*. The first, second, third, and fourth photoconductors 101*k*, 101*m*, 101*c*, and 101*y* may be arranged vertically from the bottom to the top of FIG. 1 with a predetermined distance therebetween, so as to be opposite a transfer belt 113 of the transfer unit 120 which will be described hereinafter. Specifically, the first, second, third, and fourth photoconductors 101*k*, 101*m*, 101*c* and 101*y* may come into contact with the transfer belt 113 at a constant pressure to individually define a nip region therebetween by first, second, third, and fourth transfer rollers 118*k*, 118*m*, 118*c*, and 118*y*, of the transfer unit 120 which will be described hereinafter. These photoconductors 101*k*, 101*m*, 101*c*, and 101*y* may be rotated counterclockwise by a gear train as power from a drive motor (not illustrated) may be transmitted to the gear train.

Provided respectively around the first, second, third, and fourth photoconductors 101*k*, 101*m*, 101*c*, and 101*y* may be first, second, third, and fourth charging devices 103*k*, 103*m*, 103*c*, and 103*y*, respectively, first, second, third, and fourth laser scanning devices 104*k*, 104*m*, 104*c*, and 104*y*, respectively, first, second, third, and fourth developing devices 105*k*, 105*m*, 105*c*, and 105*y*, respectively, and first, second, third, and fourth charge eliminating devices 102*k*, 102*m*, 102*c*, and 102*y*, respectively.

The first, second, third, and fourth charging devices 103*k*, 103*m*, 103*c*, and 103*y* may take the form of conductive rollers. The first, second, third, and fourth charging devices 103*k*, 103*m*, 103*c*, and 103*y* may come into contact with surfaces of the first, second, third, and fourth photoconductors 101*k*, 101*m*, 101*c*, and 101*y*, respectively. If a predetermined charging bias voltage is usable from a power supply part to the first, second, third, and fourth charging devices 103*k*, 103*m*, 103*c*, and 103*y* under control of the control part 150, the first, second, third, and fourth charging devices 103*k*, 103*m*, 103*c*, and 103*y* may charge the surfaces of the first, second, third, and fourth photoconductors 101*k*, 101*m*, 101*c*, and 101*y* with a predetermined charging electric potential, for example, a charging electric potential of about −600V when a developer has a negative polarity.

The first, second, third, and fourth laser scanning devices 104*k*, 104*m*, 104*c*, and 104*y* may irradiate laser beams, based on image signals input from a computer, scanner, etc., to the surfaces of the first, second, third, and fourth photoconductors 101*k*, 101 *m*, 101*c*, and 101*y*, respectively, charged by the first, second, third, and fourth charging devices 103*k*, 103*m*, 103*c*, and 103*y*, respectively, thereby forming electrostatic latent images having a predetermined electric potential lower than the charging electric potential, for example, a low electric potential of about −50V. The configuration of the first, second, third, and fourth laser scanning devices 104*k*, 104*m*, 104*c*, and 104*y* may be identical to a generally known configuration and thus, a detailed description thereof will be omitted.

The first, second, third, and fourth developing devices 105*k*, 105*m*, 105*c*, and 105*y* may attach developers of corresponding colors to the surfaces of the first, second, third, and fourth photoconductors 101*k*, 101*m*, 101*c*, and 101*y* on which the electrostatic latent images are formed, so as to develop the electrostatic latent images into visible developer images. The first, second, third, and fourth developing devices 105*k*, 105*m*, 105*c*, and 105*y*, respectively may include first, second, third, and fourth developer receptacles 109*k*, 109*m*, 109*c*, and 109*y*, first, second, third, and fourth developing rollers 110*k*, 110*m*, 110*c*, and 110*y*, and first, second, third, and fourth developer supply rollers 108*k*, 108*m*, 108*c*, and 108*y*.

The first, second, third, and fourth developer receptacles 109*k*, 109*m*, 109*c*, and 109*y* respectively may receive black (K), yellow (Y), magenta (M), and cyan (C) developers of a predetermined polarity, for example, a negative polarity.

The first, second, third, and fourth developing rollers 110*k*, 110*m*, 110*c*, and 110*y* may rotatably engage with the first, second, third, and fourth photoconductors 101*k*, 101 *m*, 101*c*, and 101*y*, to develop the electrostatic latent images on the first, second, third, and fourth photoconductors 101*k*, 101*m*, 101*c*, and 109*y* via attachment of the developers. The first, second, third, and fourth developing rollers 110*k*, 110*m*, 110*c*, and 110*y*, may be arranged close to the surfaces of the first, second, third, and fourth photoconductors 101*k*, 101*m*, 101*c*, and 101*y*, and may be rotated clockwise by a power transmission gear connected to the gear train that is used to rotate the photoconductors 101*k*, 101 *m*, 101*c*, and 101*y*. A predetermined developing bias voltage may be usable from the power supply part to the first, second, third, and fourth developing rollers 110*k*, 110*m*, 110*c*, and 110*y* under control of the control part 150. The predetermined developing bias voltage may be lower than a voltage usable with to the first, second, third, and fourth developer supply rollers 108*k*, 108*m*, 108*c*, and 108*y* by 100~400V, and may be, for example, about −250V.

The first, second, third, and fourth developer supply rollers 108*k*, 108*m*, 108*c*, and 108*y* may supply the developers to the first, second, third, and fourth developing rollers 110*k*, 110*m*, 110*c*, and 110*y* by use of an electric potential difference with the first, second, third, and fourth developing rollers 110*k*, 110*m*, 110*c*, and 110*y*. The first, second, third, and fourth developer supply rollers 108*k*, 108*m*, 108*c*, and 108*y* may be arranged to come into contact with lateral lower parts of the first, second, third, and fourth developing rollers 110*k*, 110*m*, 110*c*, and 110*y*, to individually define a nip region therebetween. The black (K), yellow (Y), magenta (M), and cyan (C) developers may be delivered in the first, second, third, and fourth developer receptacles 109*k*, 109*m*, 109*c*, and 109*y* by agitators to spaces underneath and between the first, second, third, and fourth developer supply rollers 108*k*, 108*m*, 108*c*, and 108*y* and the first, second, third, and fourth developing rollers 110*k*, 110*m*, 110*c*, and 110*y*.

A predetermined developer supply bias voltage may be usable from the power supply part to the first, second, third, and fourth developer supply rollers 108*k*, 108*m*, 108*c*, and 108*y* under control of the control part 150. The predetermined developer supply bias voltage may be higher than the developing bias voltage applied to the first, second, third, and fourth developing rollers 110*k*, 110*m*, 110*c*, and 110*y* by 100~400V, and may be, for example, −500V. Accordingly, once the developers are delivered to the spaces underneath and between the first, second, third, and fourth developer supply rollers 108*k*, 108*m*, 108*c*, and 108*y* and the first, second, third, and fourth developing rollers 110*k*, 110*m*, 110*c*, and 110*y*, the developers may be changed by the first, second, third and fourth developer supply rollers 108*k*, 108*m*, 108*c*, and 108*y*, thereby attaching to the first, second, third, and fourth developing rollers 110*k*, 110*m*, 110*c*, and 110*y* having a relatively low electric potential. In this manner, the developers may be moved to the nip regions between the first, second, third, and fourth developer supply rollers 108*k*, 108*m*, 108*c*, and 108*y* and the first, second, third, and fourth developing rollers 110*k*, 110*m*, 110*c*, and 110*y*.

First, second, third, and fourth cleaning devices 107*k*, 107*m*, 107*c*, and 107*y* may be provided to remove waste developer remaining on the surfaces of the first, second, third, and fourth photoconductors 101*k*, 101*m*, 101*c*, and 101*y* after one cycle rotation of the first, second, third, and fourth photoconductors 101*k*, 101*m*, 101*c*, and 101*y*. The first, second, third, and fourth cleaning devices 107*k*, 107*m*, 107*c*, and 107*y* respectively may include first, second, third, and fourth photoconductor cleaning blades 106*k*, 106*m*, 106*c*, and 106*y*.

The transfer unit 120 may serve to transfer the developer images formed on the first, second, third and fourth photoconductors 101*k*, 101*m*, 101*c*, and 101*y* to the recording medium S. The transfer unit 120 may include the transfer belt 113 and first, second, third, and fourth transfer rollers 118*k*, 118*m*, 118*c*, and 118*y*.

The transfer belt 113 may serve to deliver the recording medium S, and may be rotated in a medium delivery direction (as represented by the arrow A in FIG. 1) by a plurality of rotating rollers including a driving roller 123, first and second tension rollers 121*a* and 121*b* and a driven roller 119 arranged in sequence from the downstream of the medium delivery direction (i.e. from the upper part of FIG. 1).

A surface of the transfer belt 113 may be coated with an organic photoconductive layer, to enable the developer images formed on the first, second, third, and fourth photoconductors 101*k*, 101*m*, 101*c*, and 101*y* to be transferred to the transfer belt 113.

The first, second, third, and fourth transfer rollers 118*k*, 118*m*, 118*c*, and 118*y* may be transfer voltage applying members to apply a predetermined transfer bias voltage to the transfer belt 113. The first, second, third, and fourth transfer rollers 118*k*, 118*m*, 118*c*, and 118*y* may be arranged inside the transfer belt 113 to respectively press the transfer belt 113 by a constant pressure against the first, second, third, and fourth photoconductors 101*k*, 101 *m*, 101*c*, and 101*y*. The predetermined transfer bias voltage may be usable from the power supply part to the first, second, third, and fourth transfer rollers 118*k*, 118*m*, 118*c*, and 118*y* under control of the control part 150.

The fixing unit 115 may serve to fix the developer images transferred to the recording medium S. The fixing unit 115 may include a heating roller 115*a* and a pressurizing roller 115*b*. The heating roller 115*a* may contain a heater therein to fix the developer images to the recording medium S using high-temperature heat.

The pressurizing roller 115*b* may be pressed against the heating roller 115*a* via an elastic pressurizing member, to pressurize the recording medium S.

The paper discharge unit 116 may serve to discharge the recording medium S, on which the developer images may be fixed, into a discharge tray 117. The paper discharge unit 116 may include a paper discharge roller 116*a* and a backup roller 116*b*.

A press roller 122 may be arranged at the most upstream of the medium delivery direction (i.e. at the lower part of FIG. 1) and may be used to press the transfer belt 113 against the driven roller 119. The press roller 122 may serve to apply a constant pressure to the recording medium S and transfer belt 113, so as to allow the transfer belt 113 and recording medium S to come into close contact with each other. For example, a predetermined voltage of about 300~500V may be usable from the power supply part to the press roller 122 under control of the control part 150. With the press roller 122, the recording medium S, delivered to the transfer belt 113 by the register rollers 114, may be able to be adsorbed to and delivered by the transfer belt 113. The press roller 122 also may serve to determine a transfer voltage of the first, second, third, and fourth transfer rollers 118*k*, 118*m*, 118*c*, and 118*y* based on a load of the recording medium S. For this, a current change may be determined from a load change based on a thickness of the recording medium S between the press roller 122 and the transfer belt 113 and an environmental temperature.

Figure 2:
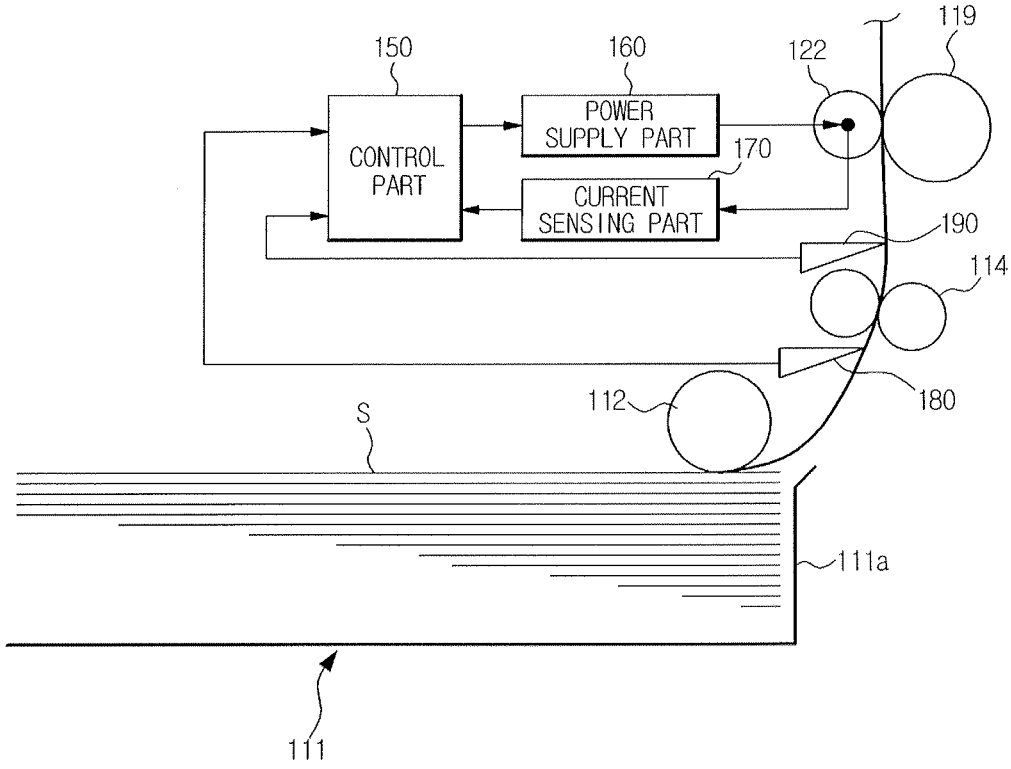
FIG. 2 is a functional block diagram of the image forming apparatus in accordance with an exemplary embodiment of the present general inventive concept.

FIG. 2 is a functional block diagram of the image forming apparatus in accordance with an exemplary embodiment of the present general inventive concept. As shown in FIG. 2, there may be provided the control part 150, power supply part 160, current sensing part 170, feed sensor 180, register sensor 190, etc.

The power supply part 160 may apply a constant voltage to the press roller 122 to apply a constant pressure to the recording medium S and transfer belt 113, in order to allow the transfer belt 113 and recording medium S to come into close contact with each other well.

The current sensing part 170 may sense a current value of the press roller 122.

The control part 150 may read and may store a current value sensed via the current sensing part 170, and may determine, based on change in current value, whether or not the recording medium S enters or exits the press roller 122. It is noted that, instead of monitoring change in current value, monitoring a change in an electric characteristic value, such as voltage or resistance, that may be changed as the recording medium S enters or exits the press roller 122, can accomplish the same result. Since the recording medium acts as a resistor, it will be appreciated that a current value in a state wherein the recording medium is engaged with the press roller 122 differs from a current value in a state wherein the recording medium is not being engaged with the press roller 122. Accordingly, based on this principle, an exemplary embodiment of the present general inventive concept may sense the entry or exit of the recording medium into or from the press roller 122. The current voltage may increase when the recording medium enters to the press roller 122, and may decrease when the recording medium exits the press roller 122. Accordingly, if the current value is increased as a result of comparing the current values before and after the recording medium enters the press roller 122, it can be determined that the recording medium enters the press roller 122. On the contrary, if the current value is decreased, it can be determined that the recording medium exits the press roller 122.

Figure 3:
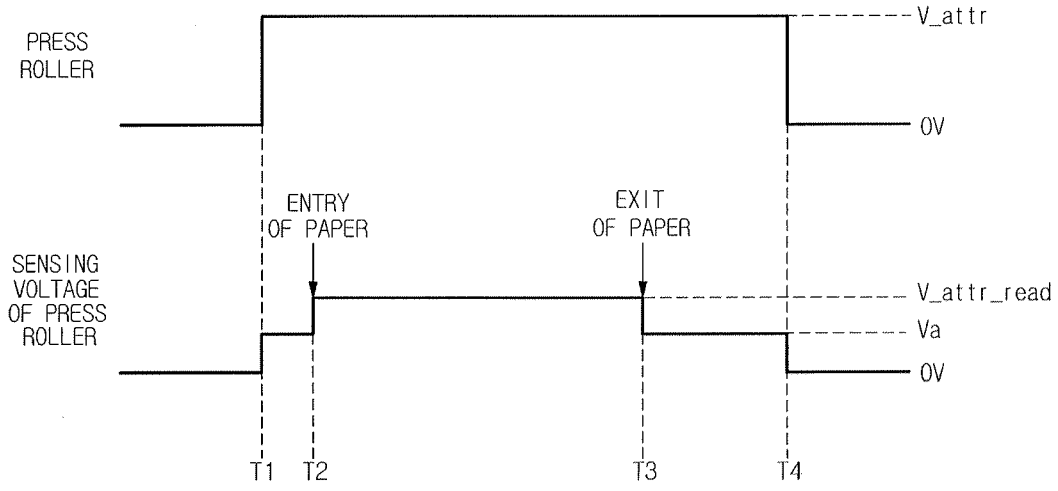
FIG. 3 is a timing chart illustrating an operation to sense entry and exit of paper based on current change of a press roller by a control part illustrated in FIG. 2.

As illustrated in FIG. 3, if a voltage V_attr of about 300~500V is usable with the press roller 122 in order to cause paper, as the recording medium, to come into close contact with the transfer belt 113 at a time T1, a sensing voltage of the press roller 122 to be input into the control part 150 may be raised from a voltage OV to a voltage Va. If the paper enters the press roller 122 at a time T2, a current value of the press roller 122 may be changed based on change in load, causing the sensing voltage of the press roller 122 to be input into the control part 150 to be raised from the voltage Va to a voltage V_attr_read. Thereby, the control part 150 may recognize entry of the paper into the press roller 122 based on change in sensing voltage corresponding to change in the current change of the press roller 122.

On the other hand, if the paper exits the press roller 122 at a time T3, the current value of the press roller 122 may be changed based on change in load, causing the sensing voltage of the press roller 122 to be input into the control part 150 to be lowered from the voltage V_attr_read to the voltage Va. Thereby, the control part 150 may recognize exit of the paper from the press roller 122 based on change in sensing voltage corresponding to change in the current value of the press roller 122.

Figure 4:
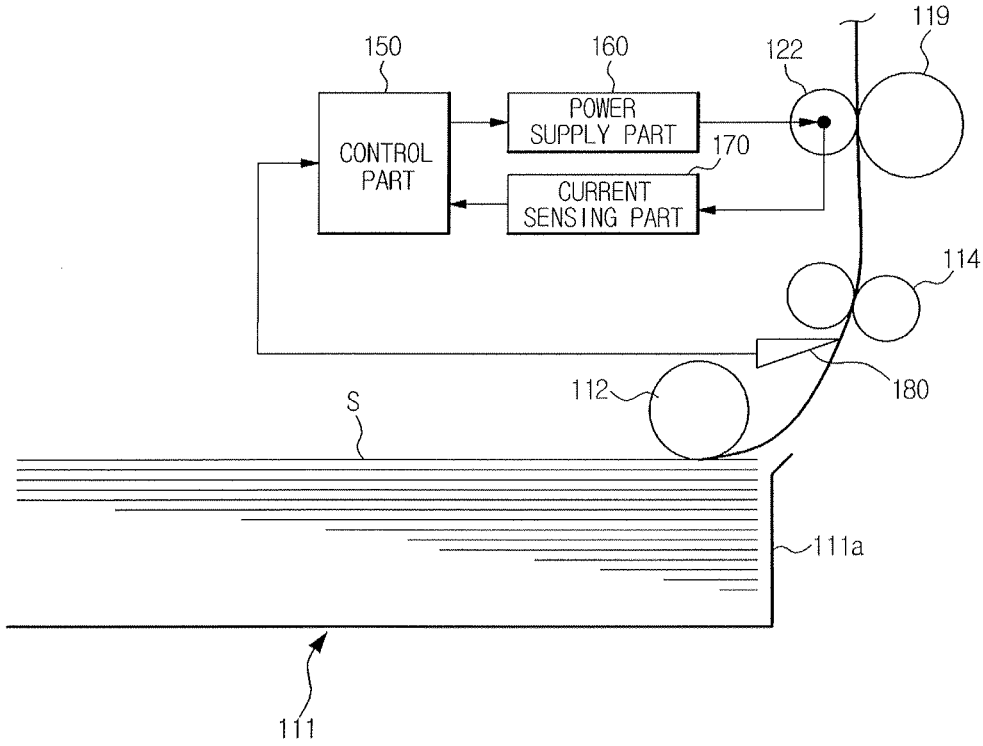
FIG. 4 is another functional block diagram of the image forming apparatus in accordance with an exemplary embodiment of the present general inventive concept.

FIG. 4 is another functional block diagram of the image forming apparatus in accordance with an exemplary embodiment of the present general inventive concept. As shown in FIG. 4, the image forming apparatus in accordance with an exemplary embodiment of the present general inventive concept may have no register sensor, so that the control part functions as the register sensor using the current change of the press roller.

Figure 5:
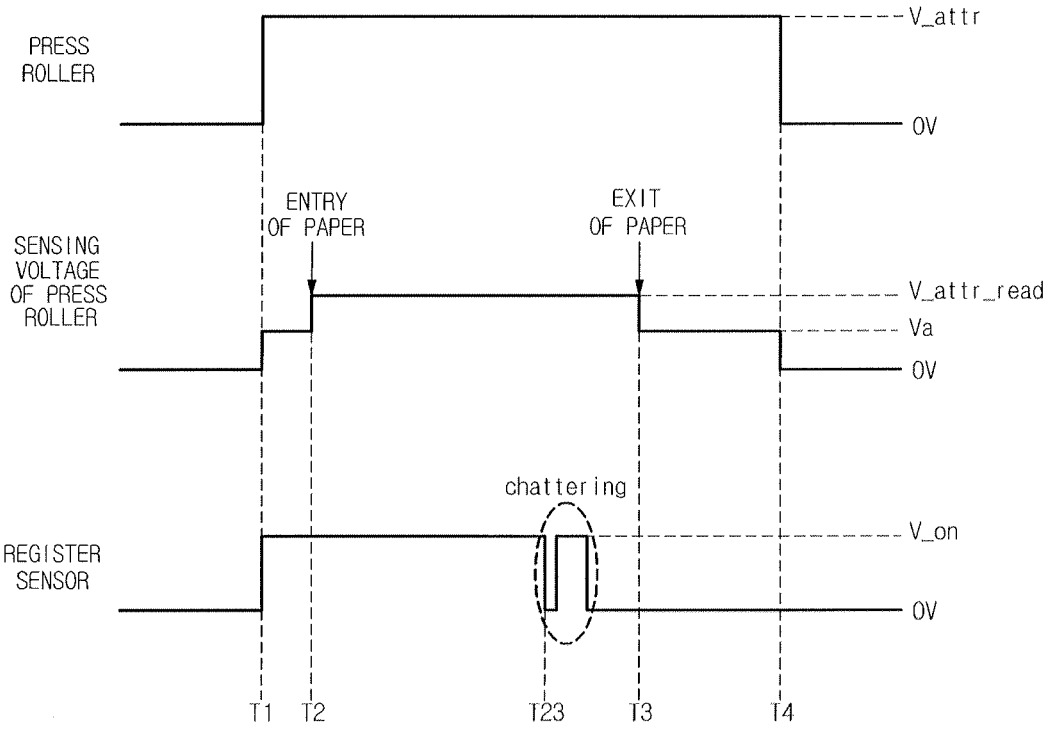
FIG. 5 is a timing chart illustrating an operation to determine malfunction of a register sensor based on current change of a press roller by a control part illustrated in FIG. 2.

As illustrated in FIG. 5, if the register sensor 190 is turned on, the control part 150 may determine entry of paper. It is noted that, when the register sensor 190 is temporarily turned off by, for example, paper vibration, the control part 150 may directly recognize exit of paper, but may recognize exit of paper only when a checked sensing voltage of the press roller 122 is lowered from the voltage V_attr_read to the voltage Va. Thereby, recognition of malfunction of the register sensor 190 due to paper vibration may be possible.

Figure 6:
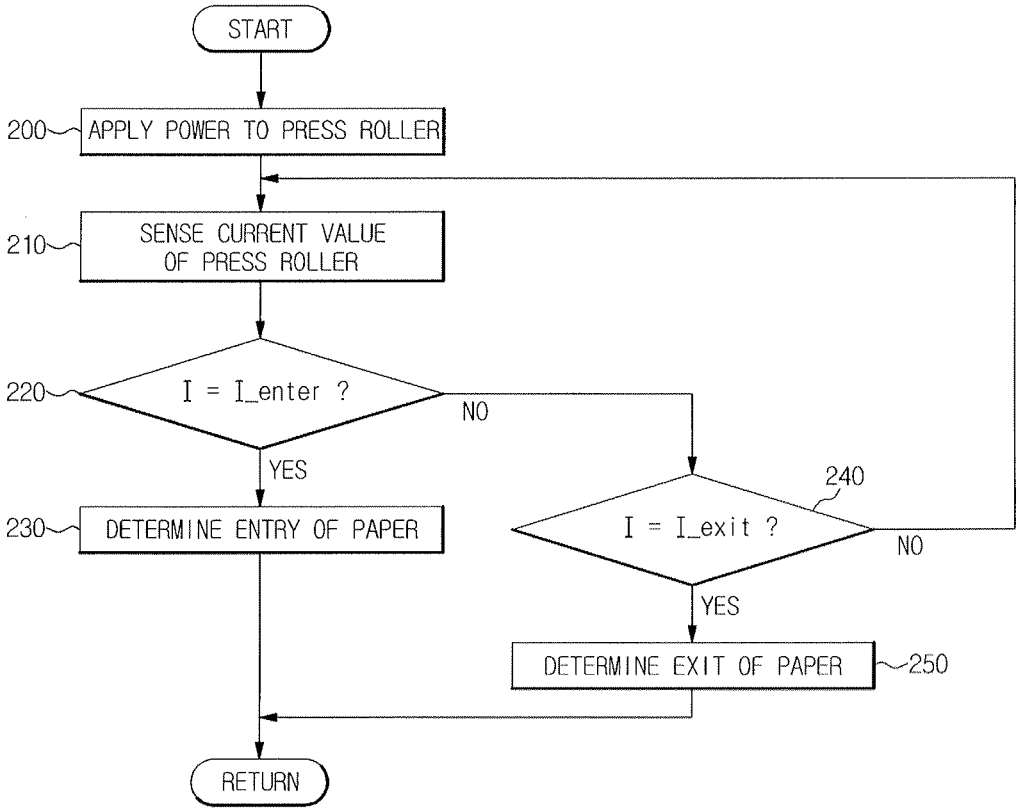
FIG. 6 is a control flow chart of the image forming apparatus in accordance with an exemplary embodiment of the present general inventive concept.
Figure 7:
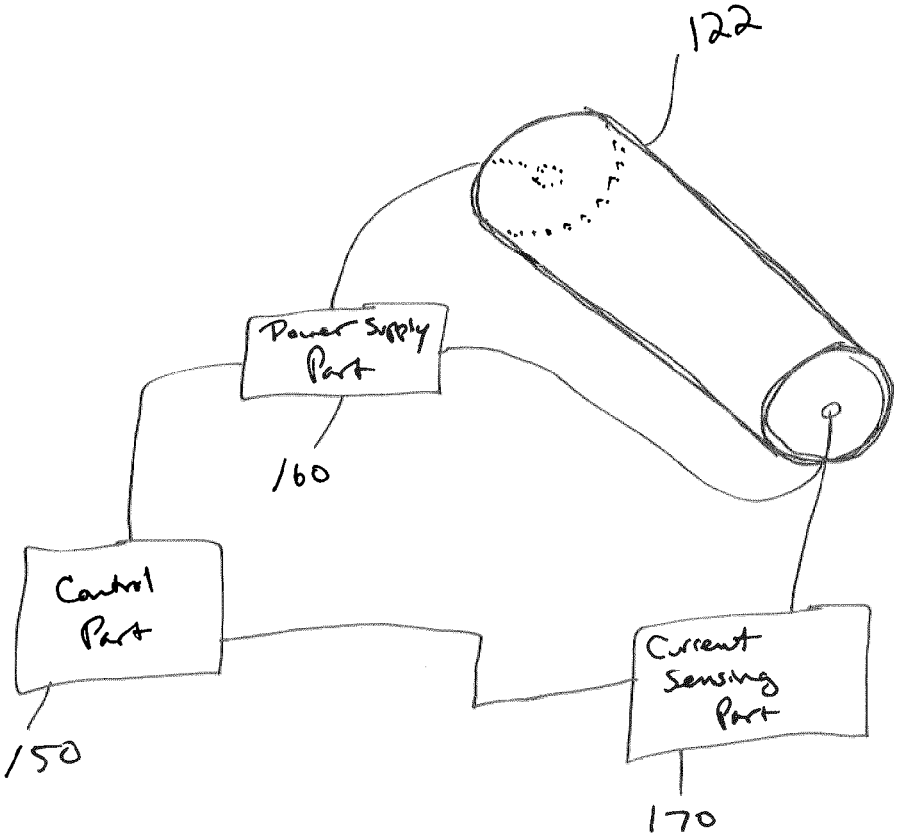
FIG. 7 is a perspective view illustrating the connectivity between the power supply part, the press roller, the current sensing part, and the control part in accordance with an exemplary embodiment of the present general inventive concept.

FIG. 6 illustrates a control method of the image forming apparatus in accordance with an exemplary embodiment of the present general inventive concept. Referring to FIG. 6, the control part 150 first may command the power supply part 160 to apply a power of about 300~500V to the press roller 122, so as to allow paper to come into close contact with the transfer belt 113 (operation, 200). After applying the power to the press roller 122, the control part 150 may command the current sensing part 170 to sense a current value of the press roller 122 (operation, 210).

After sensing the current value of the press roller 122, the control part 150 may compare the sensed current value I with a preset value I_enter corresponding to entry of paper, may determine whether or not the sensed current value I is equal to the preset value I_enter (operation, 220). If the determined result at the operating mode 220 indicates that the sensed current value I is equal to the present value I_enter corresponding to entry of paper, the control part 150 may determine that paper enters the press roller 122 (operation, 230). If entry of paper is confirmed, the control part 150 may command initiation of image formation based on the confirmed result.

On the other hand, if the determined result at the operating mode 220 indicates that the sensed current value I is not equal to the preset value I_enter corresponding to entry of paper, the control part 150 may determine that the sensed current value I is equal to a preset value I_exit corresponding to exit of paper (operation, 240). If the sensed current value I is not equal to the preset value I_exit corresponding to exit of paper, the control method may be returned to the operating mode 210, carrying out subsequent operating modes.

If the determined result at the operating mode 240 indicates that the sensed current value I is equal to the preset value I_exit corresponding to exit of paper, the control part 150 may determine that paper exits the press roller 122.

As is apparent from the above description, according to an exemplary embodiment of the present general inventive concept, entry and exit of a recording medium can be sensed without a register sensor by sensing current change of a press roller used to apply a constant pressure to the recording medium and a transfer belt so as to allow the recording medium and transfer belt to come into close contact with each other well. If an exemplary embodiment of the present general inventive concept is usable with to a model provided with a register sensor, malfunction of the register sensor can be recognized.

Although a few embodiments of the present general inventive concept have been illustrated and described, it would be appreciated by those skilled in the art that changes may be made in these exemplary embodiments without departing from the principles and spirit of the general inventive concept, the scope of which is defined in the claims and their equivalents.

What is claimed is:

1. An image forming apparatus comprising:

a press roller to press a transfer belt against a driven roller to apply pressure to the transfer belt and to apply pressure to a recording medium traveling between the press roller and transfer belt as the transfer belt rotates;

a pair of register rollers to deliver the recording medium to the press roller;

a register sensor disposed between the press roller and the pair of register rollers to register the recording medium;

a power supply part to apply power to the press roller;

a current sensing part to sense a current value of the press roller; and a control part to determine at least one of entry and exit of the recording medium to and from the press roller based on a change in current value sensed via the current sensing part and to determine whether the register sensor is malfunctioning based on a change in current value sensed via the current sensing part.

2. The image forming apparatus according to claim 1, wherein, if the sensed current value is equal to a preset value corresponding to entry of the recording medium, the control part determines that the recording medium enters the press roller.

3. The image forming apparatus according to claim 1, wherein, if the sensed current value is equal to a preset value corresponding to exit of the recording medium, the control part determines that the recording medium exits the press roller.

4. An image forming apparatus, comprising:

a press roller to press a transfer belt against a driven roller to apply pressure to the transfer belt and to apply pressure to a recording medium traveling between the press roller and transfer belt as the transfer belt rotates;

a register roller to receive the recording medium from a pick-up roller and to deliver the recording medium to the press roller;

a register sensor provided between the press roller and the register roller and used to sense the recording medium discharged from the register roller;

a power supply part to apply power to the press roller;

a current sensing part to sense a current value of the press roller; and a control part to determine the exit of the recording medium if the current value sensed via the current sensing part is equal to a preset value corresponding to exit of the recording medium when the register sensor senses the recording medium discharged from the register sensor and to determine whether the register sensor is malfunctioning based on a change in the current value sensed via the current sensing part.

5. A control method of an image forming apparatus, comprising:

applying power to a press roller used to press a recording medium against a transfer belt;

sensing the recording medium via a register sensor disposed upstream of the press roller;

sensing a current value of the press roller; and determining entry or exit of the recording medium into or from the press roller based on a change in the sensed current value and determining whether the register sensor is malfunctioning based on a change in the sensed current value.

6. The control method according to claim 5, wherein, if the sensed current value is equal to a preset value corresponding to entry of the recording medium, it is determined that the recording medium enters the press roller.

7. The control method according to claim 5, wherein, if the sensed current value is equal to a preset value corresponding to exit of the recording medium, it is determined that the recording medium exits the press roller.

* * * * *